US006790003B1

(12) United States Patent
Hu et al.

(10) Patent No.: US 6,790,003 B1
(45) Date of Patent: Sep. 14, 2004

(54) COOLING FAN WITH FLASHING LIGHT EFFECT

(75) Inventors: Kenny Hu, Taipei (TW); Tai Ta Yun, Taipei (TW)

(73) Assignee: ACT-RX Technology Corporation, Taipei (TW)

( * ) Notice: Subject to any disclaimer, the term of this patent is extended or adjusted under 35 U.S.C. 154(b) by 0 days.

(21) Appl. No.: 10/456,518

(22) Filed: Jun. 9, 2003

(51) Int. Cl.[7] ..... F01D 25/00
(52) U.S. Cl. ..... 416/5; 415/118
(58) Field of Search ..... 416/5, 61; 417/63; 415/118, 220

(56) References Cited

U.S. PATENT DOCUMENTS 5,909,944 A * 6/1999 Yajima et al. ..... 353/81
6,268,799 B1 * 7/2001 Miyashita et al. ..... 340/641
6,638,063 B2 * 10/2003 Otsuka ..... 433/29
2003/0231956 A1 * 12/2003 Lin ..... 415/118

* cited by examiner

*Primary Examiner*—Hoang Nguyen

(57) ABSTRACT

A cooling fan having flashing light effect, having a fan base, a set of blades and a plurality of light emitting diodes. The fan base further comprises a plurality of supporting levers connected to a common base. Circular axial perforation is formed in the common base, and a plurality of slots and light guides are installed near a periphery of the common base. Each light emitting diode is embedded in the corresponding slot and electrically connected to the circuit board of the set of blades.

8 Claims, 4 Drawing Sheets

COOLING FAN WITH FLASHING LIGHT EFFECT

BACKGROUND OF THE INVENTION

The present invention relates generally to cooling fan having a flashing light effect and, more particularly, to a cooling fan which provides a flashing light effect by projecting the light generated by a plurality of light emitting diodes onto a plurality of light guides, which then reflect and refract the light onto the fan base, the supporting levers and the fan blades.

Accompanied with the fast and prosperous development of computer and information technologies, designs related to personal computers are continuously updated. The demands upon computers are no longer limited to simpleton, rigid, invariable structures. In the conventional application, certain kinds of geometrics (such as transparent enclosure or streamlined exterior) and audio/video effect are rarely seen. However, to emphasize the difference and to provide added value, various types of assembled structures have been developed to meet with the consumer demands.

A conventional light emitting cooling fan is disclosed as shown in FIG. 1. The cooling fan includes a fan base 50, a set of blades 60 and a plurality of light emitting diodes 70. A central perforation 51 is formed on fan base 50. The set of blades 60 is consisting of a plurality of blades 61 and an axis 62. The blades 61 are made of luminous material. The axis 62 is fitted into the central perforation 51 of the fan base 50, and the light emitting diodes 70 are equiangularly disposed in the embedding slots 52 along a periphery of the fan base 50, and electrically connected to conductive wires 53 of a circuit board. Thereby, a light emitting cooling fan is constructed.

However, the conventional light emitting cooling fan has the following drawbacks to be resolved.

Firstly, while equiangularly embedding the light emitting diodes 70 into the slots 52 of the fan base 50, the conductive wires have to circumscribe the fan base 50 to establish the electric connection of the light emitting diodes 70. Therefore, the layout of the conductive wires is complex, and the conductive path is lengthy.

Secondly, the substrate of the embedded slots 52 formed in the fan base 50 is typically a thin plate that cannot adequately support the light emitting diodes 70. Therefore, tubular mounting seats are required for accommodating the light emitting diodes 70; and consequently, the cost is increased.

Thirdly, while being disposed in the embedding slots 52 of the fan base 50, the surfaces of the light emitting diodes 70 have to protrude from interior side walls of the slots 50 to allow the light generated thereby ultimately radiating on the blades 62. Thereby, the protruding surfaces of the light emitting diodes 70 are very close to the edges of the blades 62. For the safety concern, the diameter of the blades 62 has to be reduced; however, the reduction of diameter of the blades degrades the cooling effect of the cooling fan.

Therefore, there exist inconvenience and drawbacks for practically application of the above conventional light emitting diode. There is thus a substantial need to provide an improved light emitting diode fan that resolves the above drawbacks and can be used more conveniently and practically.

BRIEF SUMMARY OF THE INVENTION

The present invention provides a cooling fan having flashing light effect by installing a plurality of light emitting diodes in slots embedded in a fan base, and simplifying electrical connection between the light emitting diodes and a circuit board.

The cooling fan provided by the present invention is designed allowing the light generated by the light emitting diodes to radiate on light guides, which then reflect and refract the light onto the fan base, the supporting levers and the blades to provide image variation and novel visual effect.

The cooling fan provided by the present invention can also flow cool air directly onto the heat generating devices in a computer to provide rapid heat dissipation.

The cooling fan provided by the present invention comprises a fan base, a set of blades and a plurality of light emitting diodes. The fan base further comprises a plurality of supporting levers connected to a common base. Circular axial perforation is formed in the common base, and a plurality of slots and light guides are installed near a periphery of the common base. Each light emitting diode is embedded in the corresponding slot and electrically connected to the circuit board of the set of blades.

BRIEF DESCRIPTION OF THE DRAWINGS

These, as well as other features of the present invention, will become more apparent upon reference to the drawings wherein.

DETAILED DESCRIPTION OF THE INVENTION

Figure 1:
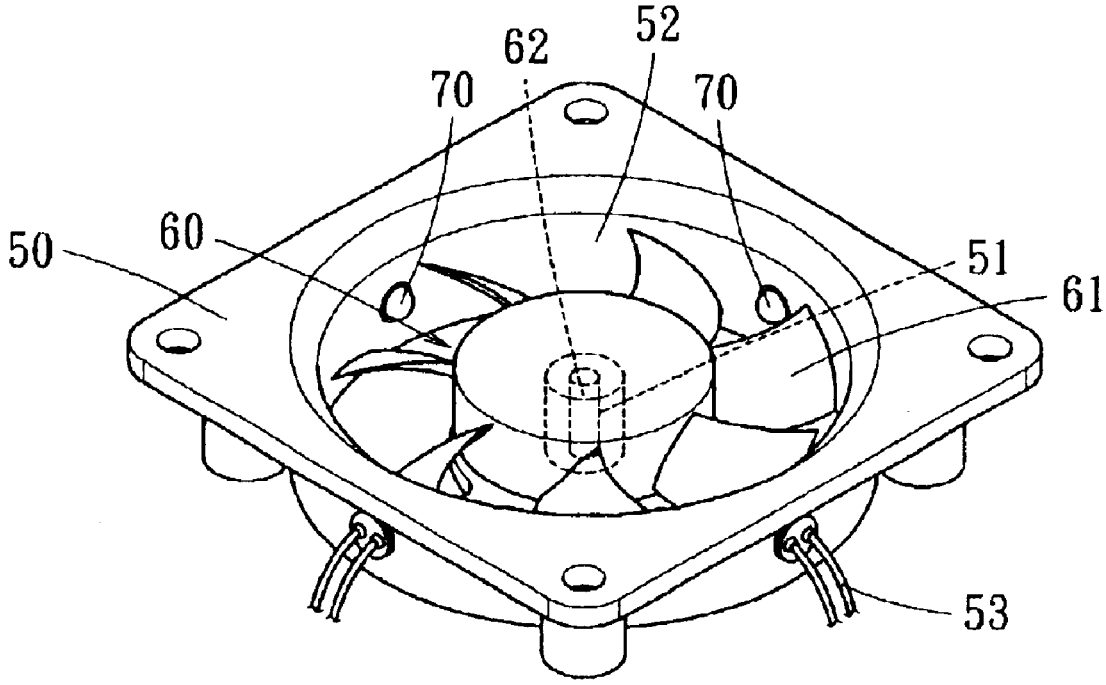
FIG. 1 PRIOR ART
FIG. 1 show a perspective view of a conventional light emitting cooling fan.
Figure 2:
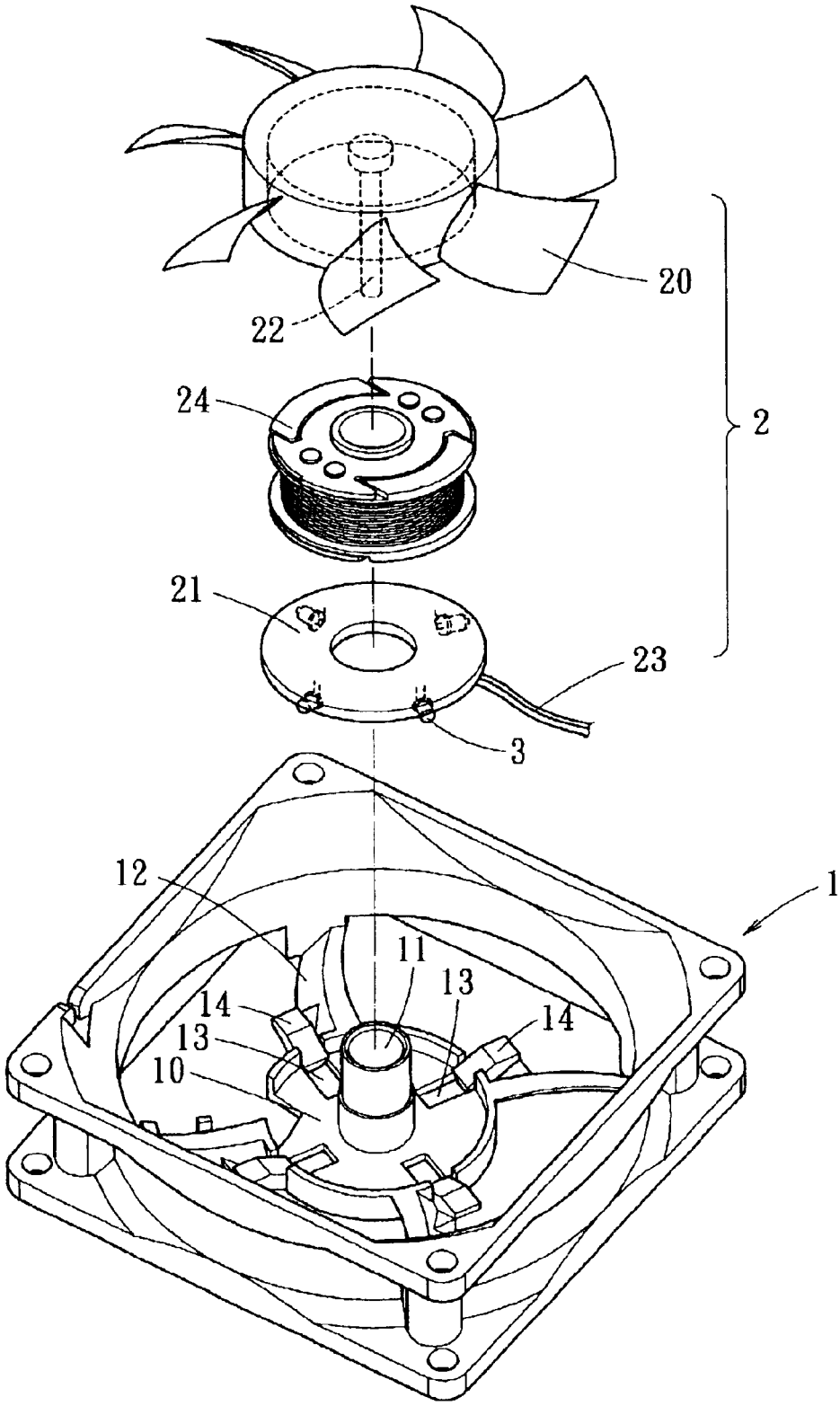
FIG. 2 is an exploded view of a cooling fan having a flashing light effect provided by the present invention.
Figure 3:
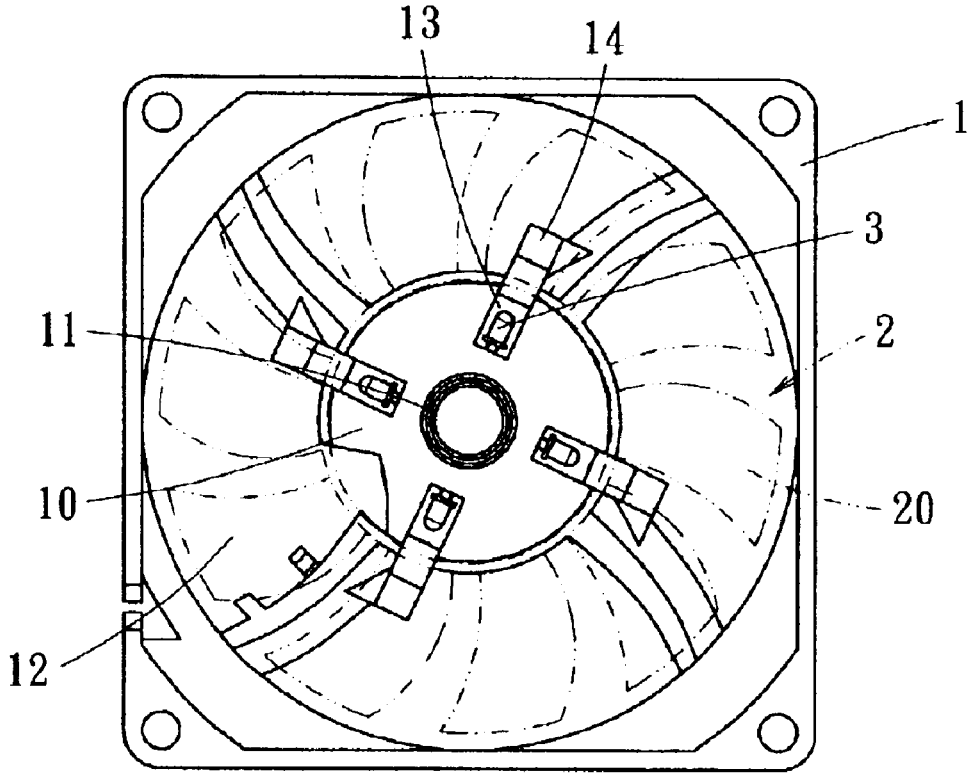
FIG. 3 shows the operation status of the cooling fan as illustrated in FIG. 3.
Figure 4:
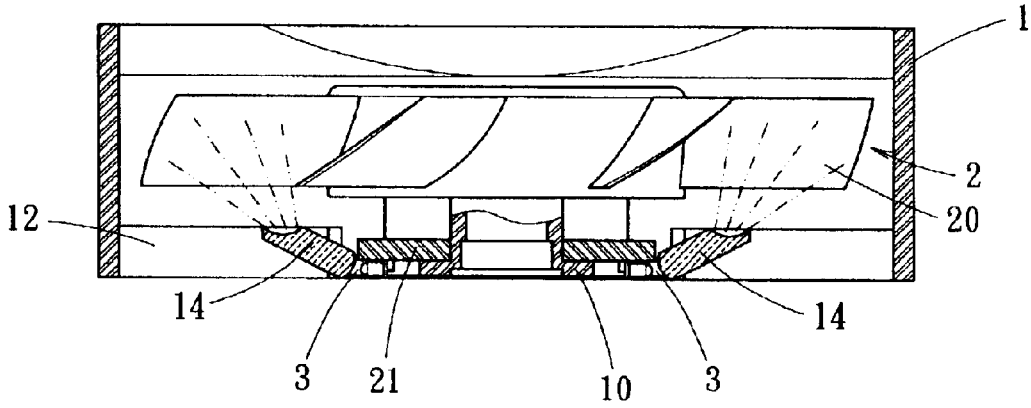
FIG. 4 is a cross sectional view showing the assembly of the cooling fan as shown in FIG. 3.

Referring to FIGS. 2, 3 and 4, a perspective exploded view, an operation status schematic, and an assembly cross sectional view of a cooling fan having flashing light effect provided by the present invention are illustrated. As shown, the cooling fan comprises a fan base 1, a set of blades 2 and a plurality of light emitting diodes 3.

The fan base 1 is made of transparent, semi-transparent or translucent material. The fan base 1 includes a plurality of supporting levers 12 with slanting planes. The supporting levers 12 are connected to a circular common base plate 10. A circular axial perforation 11 is formed at the center of the base plate 10, and a plurality of slots 13 are formed near a periphery of the base plate 10. Light guides 14 are mounted on the outer rims of the slots 13. As shown, the slots 13 are equiangularly spaced with each other, so are the light guides 14 mounted on the outer rims of the corresponding slots 13. In other words, the slots 13 are radially formed on the base plate 10 with the outer rims extending towards the periphery of the base plate 10; and the light guides 14 are mounted to the base plate 10 at the outer rims of the slots 13. Preferably, each of the light guides 14 has a bottom surface adjacent to the outer rims of the slots 13, a top surfaces facing upwardly with a slanting angle, and a side surface supported by the corresponding supporting lever 12 for form a reliable linkage. To top surface of each light guide 14 includes a concave surface to converge light or a convex surface to diverge light, and the bottom surface of each light guide 14 may includes a concave plane or a convex plane for converging or diverging light.

The set of blades 2 includes a plurality of blades 20, a circuit board 21, and a motor 24. The blades 20 are preferably formed by transparent, semitransparent or translucent material. As shown, the blades 20 extend from an axial shell, which is then mounted to the circuit board 21. The motor 24 is disposed in an axial shell, and a shaft 22 extends vertically along a central axis of the axial shell of the blades 20. A distal end of the shaft 22 is inserted into the circular axial perforation 11 to attach the set of blades 2 to the fan base 1. The circuit board 21 includes an electric wire 23 connecting to a power source.

The light emitting diodes 3 are mounted to the circuit board 22 and aligned over the corresponding slots 13 of the base plate 10. As shown, the light emitting diodes 3 are preferably mounted to a bottom surface of the circuit board 22 and then disposed into the slots 13. A power is supplied to the light emitting diodes 3 through interconnection (not shown) formed in the circuit board 22. Therefore, the layout of the electric/conductive wires is simplified and integrated. When the cooling fan is operating, the light emitting diodes 3 are activated to emit light without the requirement of additional wires to electrically connect the light emitting diodes 3 with the power supply.

The cooling fan with flashing light effect as disclosed above starts operating by conducting the power source to the set of blades 2. Meanwhile, the light generated by the light emitting diodes 3 radiates on the bottom portion of the light guides 14. A part of the light transmits through the light guides 14 and is refracted to the blades 20, which then reflects the refracted light. Another part of the light projects on the supporting lever 12 and the slanting planes of the supporting lever 12. As the supporting levers 12 are made of luminous material, a luminous effect is obtained. Further, the light projecting on the slanting planes of the supporting levers 12 are reflected to the blades 20 to generate a visual effect of flashing light. Cool air can also be blown into the computer to dissipate heat generated by the beat generating devices therein.

According to the above, the cooling fan having flashing light effect provided by the present invention has at least the following advantages.

1. As the light emitting diodes disposed in the slots of the base plate are mounted to the circuit board, the electric connection is simplified and integrated.

2. The reduction of the edge dimension of the blades is not required since the light emitting diodes are embedded in the slots of the base plate, so that the cooling effect is not degraded.

3. The light emitting diodes disposed in the slots are mounted to the circuit board and generate light transmitting through the light guides, such that variable optical image effect can be obtained.

Other embodiments of the invention will appear to those skilled in the art from consideration of the specification and practice of the invention disclosed herein. It is intended that the specification and examples to be considered as exemplary only, with a true scope and spirit of the invention being indicated by the following claims.

What is claimed is:

1. A cooling fan having flashing light effect, comprising:

a fan base, the fan base comprising a plurality of supporting levers connected to a common base plate, the common base plate comprising an axial perforation, a plurality of slots and a plurality of light guides thereon;

a set of blades, comprising plurality of blades and a circuit board connected to a power source;

and a plurality of light emitting devices embedded in the slots and mounted to and electrically connected to the circuit board.

2. The cooling fan of claim 1, wherein the fan base is made of transparent or translucent material.

3. The cooling fan of claim 1, wherein the slots are equiangularly spaced with each other.

4. The cooling fan of claim 1, wherein each of the supporting levers comprises a slanting plane for reflecting a light incident thereon to the blades.

5. The cooling fan of claim 1, wherein the light guides each has a concave or convex top surface.

6. The cooling fan of claim 1, wherein the light guides each has a concave or convex bottom surface.

7. The cooling fan of claim 1, wherein the light guides is disposed with a top surface thereof facing upwardly with a slanting angle.

8. The cooling fan of claim 1, wherein the blades are made of transparent or translucent material.

* * * * *